United States Patent [19]

Hagen et al.

[11] 3,961,436

[45] June 8, 1976

[54] FORE-END AND BARREL SUPPORT

[75] Inventors: Leonard J. Hagen, Herkimer; James S. Martin; Clark B. Workman, both of Mohawk, all of N.Y.

[73] Assignee: Remington Arms Company, Inc., Bridgeport, Conn.

[22] Filed: Mar. 28, 1975

[21] Appl. No.: 563,107

[52] U.S. Cl. ..... 42/75 B; 42/17

[51] Int. Cl.[2] ..... F41C 27/00

[58] Field of Search ..... 42/75 B, 75 A, 75 C, 42/17, 21; 89/191 A, 191

[56] References Cited

UNITED STATES PATENTS 2,594,862 4/1952 Browning ..... 42/75 C 3,200,710 8/1965 Kelly et al. ..... 89/191 A

*Primary Examiner*—Charles T. Jordan

*Attorney, Agent, or Firm*—John H. Lewis, Jr.; Nicholas Skovran; William L. Ericson

[57] ABSTRACT

A support member positioned between a receiver assembly and the rear end of a removable barrel assembly having "C" sections on each side of the support member to support the rear end of the fore-end and also to permit sliding movement of an action bar assembly therein. At the rear of the support member is a spring section which is positioned between the receiver assembly and the barrel assembly to compensate for variations of tolerances between the barrel assembly and the receiver assembly.

10 Claims, 4 Drawing Figures

FORE-END AND BARREL SUPPORT

This invention relates in general to an improved fore-end support which also functions to support a barrel assembly in a receiver assembly. More specifically, the invention relates to a fore-end and barrel support wherein the support of the barrel is effected by means of a spring means positioned between the barrel assembly and the receiver assembly.

The significance of the present invention is better understood when the improved fore-end and barrel support is placed in its proper perspective, i.e. as a part of a gas-operated autoloading shotgun. At the risk of over-simplifying, such shotguns have the bolt mechanism connected to an action bar which in turn is operatively connected to an action bar sleeve which is actuated by explosive gases which bleed through an orifice in the shotgun barrel after the explosively-projected shot and wad column pass the orifice. See U.S. Pat. No. 3,200,710 issued on Aug. 17, 1965 to R. P. Kelly et al for a showing of the type of gas-operated autoloading shotgun in which the present invention has utility.

It is a general object of the present invention to improve a fore-end and barrel support currently being used in the gas-operated autoloader shown in the Kelly patent cited above.

More specifically, it is an object of this invention to provide a fore-end and barrel support which is more economical to make and to position on the shotgun as well as to improve endurance of the fore-end and barrel support.

These and other objects, features, and advantages of the invention will be more fully brought out in the following specification, claims, and drawings in which:

Figure 1:
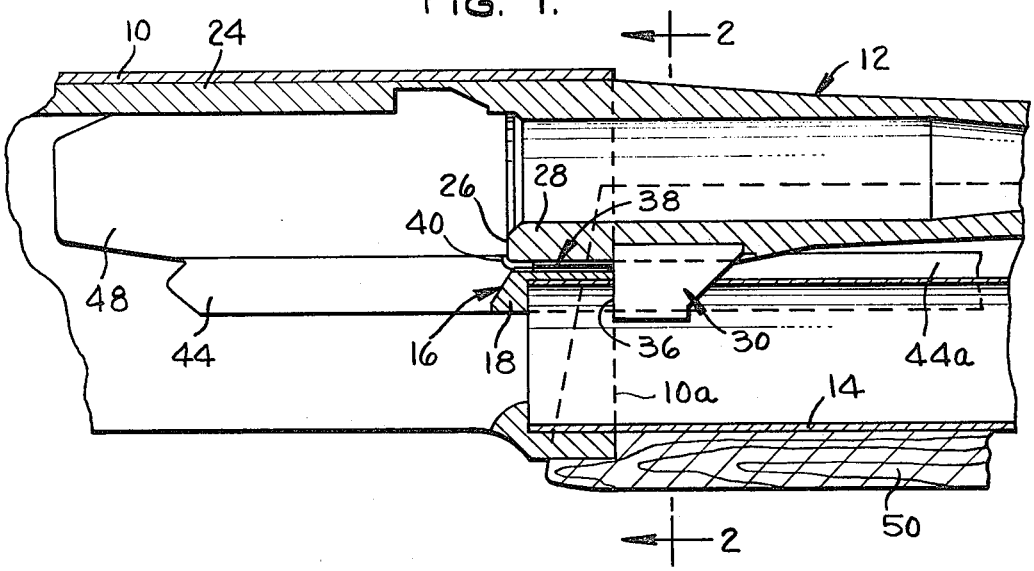
FIG. 1 shows a cross-sectional, elevational view of a portion of a gas-operated autoloading shotgun incorporating the present invention.

Referring now to the drawings, FIG. 1 shows a firearm receiver 10 in which a barrel assembly 12 is inserted in such a manner so as to permit the barrel assembly to be readily removable in any conventional manner. Integrally connected to said receiver 10 in a manner not shown but again in any conventional manner, such as brazing, is an elongated hollow magazine tube 14 in which shotshells may be positioned for autoloading operation of the firearm.

A support member 16 is integrally formed, brazed or mounted in any other known fashion to the upper part of the rear end of said magazine tube. The rear portion 18 of the support member 16 extends rearwardly and downwardly of the rear end of said magazine tube 14 (see FIG. 1) while the forward portion has a concave underportion 20 to fit the top of the cylindrical magazine tube and a flat upper portion 22 for a purpose to be explained later.

The barrel assembly 12 has a barrel extension 24 which has a portion 26 of its lower circumference cut away in order to permit feeding of the shotshells into the gun chamber. When in the assembled position, the rear end portion 28 of the barrel (whose barrel extension has been cut away) rests over the flat upper portion 22 of the support member 16 and is spaced therefrom a distance which varies depending on the tolerances of the barrel assembly and the receiver assembly, including of course the support member.

The present invention is utilized in this area of the firearm.

Figure 3:
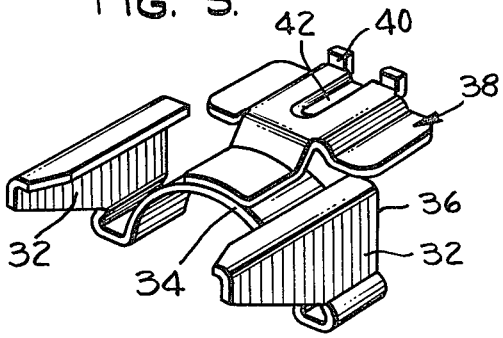
FIG. 3 shows a perspective view of the fore-end and barrel support shown in FIGS. 1 and 2.

The fore-end and barrel support member 30 shown in FIG. 3 comprises two spaced-apart, axially-extending C sections 32 connected by a concave central portion 34. The C sections have an end wall portion 36 which is perpendicular to the axial direction of the C sections 32 (see FIG. 1). A spring support section 38 is connected to the center of the concave portion 34 and extends upwardly and rearwardly therefrom. The spring section 38 can be integrally formed with the concave portion 34 or it can be spot welded or brazed thereto or attached in any suitable manner. At the rear end of the spring section 38 are two upwardly extending tabs or stops 40. Running axially in said spring section 38 is a groove or depression 42 for a purpose to be described later.

Figure 5:
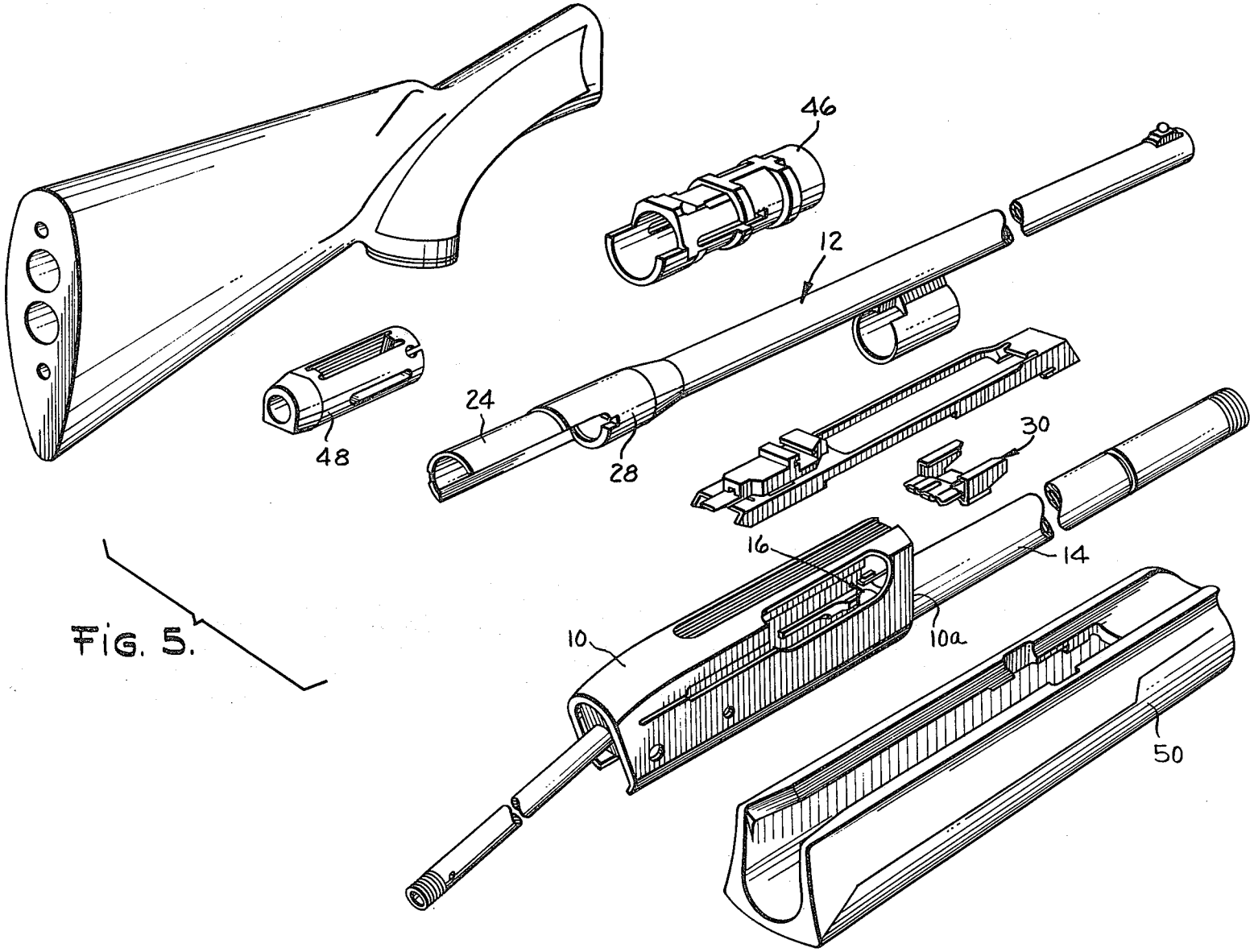
FIG. 5 shows an exploded view of a firearm incorporating the present invention with only the major elements shown for purposes of clarity.

The device, i.e. the fore-end and barrel support member 30, assembles to an action bar assembly 44. Only the action bars **44*a* - one on each side of the magazine tube 14 - are shown in FIG. 1, but it is to be understood that an action bar sleeve 46 is positioned to the right of the cut-off point in FIG. 1 of the drawing, i.e. forwardly on the firearm (see FIG. 5). The action bar sleeve is actuated by explosive gases bled from an orifice in the gun barrel upon firing and propels the action bars 44*a* and the attached bolt means 48** rearwardly. This construction is well known and does not constitute any part of the present invention.

The construction is mentioned here because the fore-end and barrel support members "ride" on the action bars when the barrel assembly is not connected to the firearm, or to put it another way the action bars **44*a* ride or slide in the spaced-apart C sections of the fore-end and barrel support member. If the fore-end and barrel support member 30** is free to slide on the action bars when the barrel assembly is in place and the gun is fired, it is possible for the action bar sleeve to impact against the fore-end and barrel support member and eventually cause a failure of the member. This is avoided by the present invention.

Figure 2:
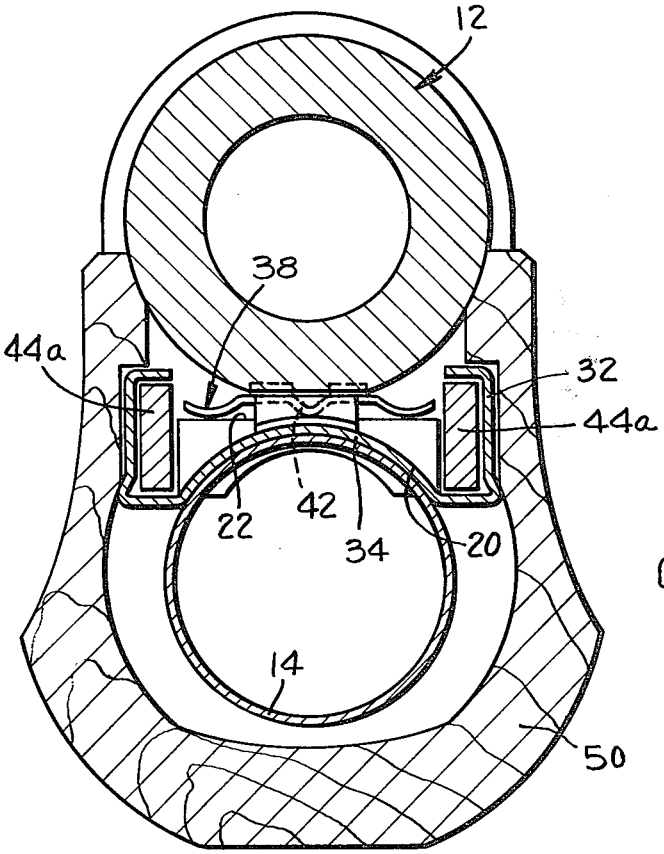
FIG. 2 shows an end view of the shotgun of FIG. 1 taken along Line A—A thereof.

As shown in FIGS. 1 and 2, when the fore-end and barrel support member is in position, the rear end wall portion of the C sections abuts against the forward end **10*a* of the receiver and the spring section 38 will rest on the flat portion 22 of magazine tube support member 16 and depending on the tolerances mentioned above will occupy the space between the barrel assembly and the receiver assembly to be spring-biased upwardly against and support the barrel assembly. The device is positioned and shaped so that spring action compensates for the variation of tolerances between the receiver assembly and the barrel assembly. The groove 42 in the center of the spring section 38** is a positive stop when the space is to minimum clearance.

The upwardly extending tabs or stops 40 engage the rear end portion 28 of the barrel and prevents the fore-end and barrel support members from sliding forwardly on the action bars and thus prevents any impacting of the fore-end and barrel support by the action bar sleeve.

As can be seen in FIG. 2, the forward or C shaped portions of the device also serve to support the rear end of the fore-end 50. This function, however, is similar to the prior art device shown in FIG. 4 and described below.

Figure 4:
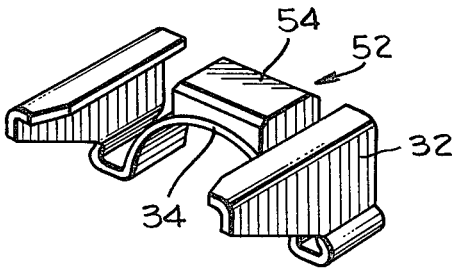
FIG. 4 shows a perspective view of a fore-end and barrel support presently being used in the gas-operated autoloader shown in the Kelly patent, which is assigned to the assignee of the present invention.

The prior art device 52 shown in FIG. 4 also acts as a fore-end and barrel support member. The C shaped portion is essentially the same as is the curved section connecting the spaced-apart C sections. The prior art device, however, includes a support block 54 which is a rectangular block of metal bevelled at two upper ends. The support block 54 is spot welded to the concave portion to form the assembly. This device was assembled to the action bars in the same manner described above. However, the fitting of the device to the barrel assembly and the receiver assembly was accomplished by filing the support block 54 individually and by hand until there was a proper fit between the receiver assembly and the barrel assembly. When barrel assemblies are changed, as they often are, the fit between the involved components would not necessarily be tight because the support block was filed or specially made for a specific barrel. If the fore-end and barrel support member is not tight and is permitted to slide forwardly on the action bars before firing, it can be struck by the action bar sleeve on its return cycle when the firearm is discharged. Constant striking of the fore-end and barrel support by the action bar sleeve can cause breakage of the fore-end support.

This problem is obviated with the present invention, since the spring action of the device compensates for the variation of tolerance space between the barrel assembly and the support member on the receiver assembly.

In summary, the advantages of the present device, i.e. the present fore-end and barrel support member, are: (1) the device supports the barrel assembly in the receiver assembly and also supports the rear of the fore-end; (2) the device compensates for variation of tolerances between the barrel assembly and the receiver assembly; (3) the device eliminates special hand fitting by filing of the device presently used; (4) the device maintains a tight fit between the two assemblies when barrels are interchanged inasmuch as the prior art support member is filed or fitted for a specific barrel assembly and no two barrel assemblies will be exactly alike; (5) the device eliminates breakage caused by poor welds due to two different compositions of materials (such as in the prior art device) and wide variations of thicknesses, the device can be made in two parts of equal thickness and the same kind of material, making it possible for better assembly techniques such as spot welding, brazing, etc.; (6) the device can also be made as a one-piece device; (7) the device is correctly fitted between the barrel assembly and the receiver assembly thus preventing it from moving on the action bars so as to be struck by the action bar sleeve and the receiver assembly; (8) the tabs or stops on the rear end of the device make it almost impossible to assemble the barrel into the receiver and have the firearm function unless the fore-end and barrel support is properly installed; and (9) the new device is lighter in weight to the prior art device.

What is claimed is:

1. In a firearm having a receiver with an attached magazine tube assembly projecting therefrom, an action bar assembly slidably mounted on said magazine tube assembly, a removable barrel assembly mounted in said receiver directly above and parallel to said magazine tube assembly, and a fore-end positioned over said action bar assembly and said magazine tube assembly, the improvement comprising a support member positioned between said barrel assembly and said magazine tube assembly, means attaching said support member to said action bar assembly to permit sliding movement of said action bar assembly therein, said support member having means thereon for co-operating with corresponding means on said fore-end to support said fore-end on the firearm, and spring means on said support member having a predetermined amount of resiliency for maintaining a firm support for said barrel assembly on said magazine tube assembly regardless of variations in manufacturing tolerances of the barrel assembly, the magazine tube assembly, and the receiver.

2. In a firearm as recited in claim 1 wherein said means attaching said support member to said action bar assembly comprising two laterally spaced C shaped sections in which said action bar assembly slides, said C shaped sections having their lower end portions connected by an arcuate section which rests on said magazine tube assembly, said spring means comprising an upwardly-projecting cantilever spring section attached to the middle portion of said arcuate bearing section.

3. In a firearm as recited in claim 2 wherein said cantilever spring section has upwardly-projecting stop means to engage said barrel assembly to prevent forward movement of said support member when the action bar assembly is moved forwardly to the closed position.

4. In a firearm as recited in claim 3 wherein said cantilever spring section has means thereon for limiting the amount of deflection of said spring section.

5. In a firearm as recited in claim 4 wherein said limiting means comprises a downwardly-projecting groove in said cantilever spring section.

6. In a firearm as recited in claim 3 wherein said cantilever spring section is made of the same material as said C shaped sections and said arcuate bearing section.

7. In a firearm as recited in claim 2 in which said magazine tube assembly comprises a cylindrical tube having a barrel support means integrally mounted on the rear end thereof, said barrel support means having a substantially horizontal surface against which said cantilever spring section is biased when said barrel assembly is in locked position in said receiver.

8. In a gas-operated autoloading firearm having a receiver with a magazine tube assembly connected thereto, an action bar assembly slidably mounted on said magazine tube assembly, a barrel assembly detachably positioned in said receiver and extending substantially parallel to said magazine tube assembly, and a fore-end assembly attached at its forward end to the forward end of said magazine tube assembly, the improvement comprising support means located between the rear end portions of said barrel assembly and said magazine tube assembly and spring biased thereagainst to provide support for said barrel assembly and also to support the rear end of said fore-end assembly.

9. In a gas-operated autoloading firearm as recited in claim 8, said support means comprising horizontally spaced apart C shaped sections connected together by an arcuate central section and a rearwardly extending cantilever spring section attached to said arcuate section, said C shaped sections being slidably mounted on said action bar assembly when said barrel assembly is not positioned in said receiver, said arcuate section conforming to and resting on said magazine tube assembly, said cantilever spring section having sufficient resiliency to compensate for manufacturing tolerances of said receiver, said barrel assembly, and said magazine tube assembly, while maintaining a spring-biasing action between said magazine tube assembly and said barrel assembly.

10. In a gas-operated autoloading firearm as recited in claim 9 wherein said cantilever spring means comprises upwardly projecting stop means for engaging said barrel assembly to prevent forward movement of said support member on the action bar assembly when the barrel assembly is connected to the receiver.

* * * * *